US005859124A

United States Patent [19]

Yorifuji et al.

[11] Patent Number: 5,859,124

[45] Date of Patent: Jan. 12, 1999

[54] LUBRICANT FOR USE IN HOT WORK

[75] Inventors: Akira Yorifuji; Takaaki Toyooka; Ken Shimamoto; Masaharu Kita; Taro Kanayama, all of Aichi, Japan

[73] Assignee: Kawasaki Steel Corporation, Japan

[21] Appl. No.: 839,209

[22] Filed: Apr. 22, 1997

[30] Foreign Application Priority Data

Oct. 30, 1996 [JP] Japan ..... 8-303533

[51] Int. Cl.[6] ..... C10M 173/02

[52] U.S. Cl. ..... 524/837; 524/838; 508/143; 71/42

[58] Field of Search ..... 508/143; 74/42; 524/838, 837

[56] References Cited

U.S. PATENT DOCUMENTS

| | | | |
|---|---|---|---|
| 2,846,393 | 8/1958 | Cook et al. | 252/33.3 |
| 3,873,458 | 3/1975 | Parkinson | 252/49.5 |
| 3,909,424 | 9/1975 | Clark | 252/12 |
| 3,933,656 | 1/1976 | Reick | 252/25 |
| 4,027,512 | 6/1977 | Treat | 72/42 |
| 4,128,487 | 12/1978 | Karpen | 252/28 |
| 4,148,970 | 4/1979 | McIntosh et al. | 428/469 |
| 4,202,193 | 5/1980 | Wilson | 72/42 |
| 4,401,579 | 8/1983 | Kratzer | 252/17 |
| 5,273,667 | 12/1993 | Gill et al. | 252/25 |
| 5,494,594 | 2/1996 | Rodzewich | 252/49.3 |
| 5,624,888 | 4/1997 | Przbylski et al. | 508/161 |
| 5,691,282 | 11/1997 | Periard et al. | 508/113 |

*Primary Examiner*—Margaret W. Glass
*Attorney, Agent, or Firm*—Austin R. Miller

[57] ABSTRACT

A lubricant is provided for use in hot working such as cross-roll rolling of a seamless steel pipe. It effectively reduces the friction coefficient between the working tools and the material under the hot work, thus extending the lives of the tools. The lubricant contains: (A) from about 10 to about 60 wt % of alkali silicate; (B) from about 1 to about 20 wt % of silane coupling agent; (C) from about 0.1 to about 5.0 wt % of at least one kind of alkali compound selected from a group consisting of an alkali hydroxide, an alkali carbonate, an alkali borate and an alkali salt of mineral acid; and (D) from about 30 to about 70 wt % of water. Alternatively, the lubricant contains: (A) from about 10 to about 60 wt % of alkali silicate; (B) from about 1 to about 20 wt % of silane coupling agent; (C) from about 0.1 to about 5.0 wt % of at least one kind of alkali compound selected from a group consisting of an alkali hydroxide, an alkali carbonate, an alkali borate and an alkali salt of mineral acid; (D) from about 5 to about 50 wt % of water; (E) from about 10 to about 60 wt % of iron oxide; and (F) from about 0.1 to about 5.0 wt % of at least one additive selected from a group consisting of a dispersant and a thickening agent.

13 Claims, 2 Drawing Sheets

LUBRICANT FOR USE IN HOT WORK

BACKGROUND OF THE INVENTION

1. Field of the Invention

The present invention relates to a lubricant adapted for use in hot work and, more particularly, to a lubricant which is suitably applied to the surfaces of hot-work tools such as a plug, guide shoe and so forth employed in a process for producing a seamless steel pipe through rolling by a cross rolling mill.

2. Description of the Related art

In general, a process for producing a seamless steel pipe in accordance with the Mannesmann method basically has the steps of: (1) piercing a round billet to form a hollow bloom; (2) elongating the hollow bloom to elongate the same; and (c) finish-rolling the tube. The steps including the piercing, elongating and finish rolling are performed with the help of tools and devices such as plugs, guide shoes, rolls and so forth.

Among these tools and devices, plugs are easily worn. Reducing the wear of the plugs is beneficial from the view point of efficiency, economy and product quality in the pipe production process. The surface of the plug is covered by a thick oxide scale which is closely adhered to the base material. The scale serves as a heat insulating layer for protecting the plug body, thus directly affecting the life of the plug. In addition, the scale reduces the rolling load and prevents deterioration. The scale alone, however, cannot provide satisfactory protective effect in many instances. Attempts have been made, therefore, to lubricate plugs used for directly piercing billets, by applying lubricants to the plugs.

For instance, Japanese Unexamined Patent Publication Nos. 51-57729 and 1-180712 disclose methods in which an oily lubricant is sprayed from the end of the plug. Japanese Unexamined Patent Publication No. 5-138213 discloses a method in which a graphite-type lubricant is applied to the plug surface before the plug is used for piercing. The first-mentioned method, however, has not yet been successfully introduced to the industry, because of difficulty encountered in forming a spray nozzle on the plug's head without impairing the shape of the plug's head which is an important factor of the plug design in the piercing process. The second-mentioned method also suffers from a disadvantage in that the graphite allows slippage of the plug. Thus, the graphite does not fully contribute to the improvement in the piercing efficiency but, rather, involves a risk of allowing problems such as failure in biting the material to be rolled and failure in the sticking of the tail end of the rolled material from the roll.

The conditions under which the plugs are used are becoming more severe, due to the current tendency towards the use of stainless steels and alloy steels to form seamless steel pipes. This is because alloy steels pose higher levels of piercing loads than ordinary steels. More specifically, when an alloy steel is used as the pipe material, the scale on the plug surface is exfoliated in a short time due to the heavy piercing load, so that the plug directly acts on the material subjected to rolling without an intermediate layer which would serve as a heat-insulating and lubricating layer, with the result that the wear of the plug is promoted.

In the production of a seamless steel pipe by a Mannesmann-type piercing mill, the pipe material is rolled and pierced by means of a pair of opposing skews or cross rolls and a plug. At the same time, a pair of guide shoes are used to prevent the outside diameter of the rolled material from increasing due to the rolling. The guide shoes may be of a stationary type or of a diskroll type.

The surfaces of the guide shoes are in such a state as to permit easy slip of the guide shoes with respect to the surface of the rolled material in the circumferential direction of the material. In addition, the guide shoes which act to prevent radial expansion of the material have to sustain a large reaction force. Consequently, the surfaces of the material tend to adhere to the guide shoes surface subjected to rolling, particularly when the material to be rolled is a high-alloy steel represented by about 13% Cr steel, about 22% Cr steel or stainless steel.

As measures for preventing such score, Japanese Unexamined Patent Publication No. 60-56406 and Japanese Examined Patent Publication No. 5-16925 disclose, respectively, methods for rolling while supplying the guide shoe surface with graphite-type lubricant and a boric acid type lubricant. In both methods, application of the lubricant to the guide shoe surface is performed by spraying.

Each of these lubricating methods, however, suffers from a problem in that flaws are liable to be generated due to insufficient anti-scoring effect when the rate of supply of the lubricant is too small. Conversely, excessive supply of the lubricant tends to cause a rolling failure due to slip between the rolled material and the rolls which undesirably reduces the friction coefficient, particularly when the lubricant is of the graphite type as disclosed in Japanese Unexamined Patent Publication No. 60-56406. When the lubricant is of the boric acid type as proposed in Japanese Examined Patent Publication No. 5-16925, the lubricant tends to be washed away by a large quantity of water such as that used for cooling, thus impairing the anti-scoring effect.

Japanese Unexamined Patent Publication No. 6-142749 discloses a method in which a billet is rolled while its surface is being supplied with a lubricant of the sodium silicate type. Japanese Unexamined Patent Publication No. 7-116709 discloses a method in which rolling is conducted while supplying the roll surface with a lubricant of swelled mica-type lubricant.

These methods, however, have the following shortcomings. The method disclosed in Japanese Unexamined Patent Publication No. 6-142749, which relies upon the application of a sodium silicate type lubricant on the billet surface during rolling, allows the exfoliation of the scale from the rolled material during transportation or rolling of the billet, as well as the separation of the lubricant from the material surface, thereby failing to provide appreciable anti-scoring effect. The method disclosed in Japanese Unexamined Patent Publication No. 7-116709, which relies upon the application of a swelled mica-type lubricant on the roll surface during rolling, is also liable to fail to satisfactorily prevent seizure because the lubricant tends to be washed away by the supply of a large quantity of water such as roll cooling water and the separation of lubricant due to exfoliation of the scale from the surface of the material subjected to the rolling.

Japanese Unexamined Patent Publication No. 5-148493 discloses the use of an aqueous solution of sodium silicate containing graphite or mica as a lubricant for lubricating a rolled material. This water-glass type lubricant, when heated, foams by allowing water content to evaporate therefrom and becomes a pumice-like substance which is then vitrified when the temperature reaches a softening point. When this type of lubricant is applied to the outer surface of the hot material to be rolled, the lubricant is softened into a glassy state so as to produce a lubricating effect upon contact with the guide shoes and rolls. This type of lubricant, by virtue of its liquid nature, can easily be applied to plugs and guide shoes which are normally held at comparatively low temperatures and, hence, seems to be suitably usable as a lubricant for such plugs and guide shoes. The inventors have found, however, that this type of lubricant cannot exhibit appreciable lubricant effect when applied to the plugs and guide shoes, for the reason that the lubricant when so used is subjected to a shearing load before it is heated up to the softening point at which it becomes glassy so that it easily comes off the surface of the plug or the guide shoe.

Japanese Unexamined Patent Publication No. 5-171165 discloses a lubricant for a material to be rolled. This lubricant has a composition composed of a particulate oxide-type laminar compound and a binder containing an alkali borate mixed with boron oxide and boric acid. Unfortunately, this lubricant does not exhibit a liquid state and, hence, cannot exhibit satisfactory adhesion or spreading by melting on the surface of a plug or guide shoes, which are usually cooled to temperatures much lower than that of the rolled material, which is usually at an elevated temperature of 900° C. or higher at the internal hollow surface.

Thus, in the field of production of seamless steel pipes by the Mannesmann method, it is desirable to decrease the coefficient of friction between the material subjected to rolling and the tools such as the plug and guide shoes which are used in the step of piercing a billet and the subsequent elongating and rolling steps, thereby prolonging the lives of the plug and the guide shoes. This is particularly desirable in the cases where the billet to be processed is made of a material which imposes a heavy load on the rolling tool and other devices, such as a stainless steel or an alloy steel, is used as the material of the billet.

SUMMARY OF THE INVENTION

Accordingly, an object of the present invention is to provide a lubricant which is suitable for use in hot working procedures, such as the rolling of a seamless steel pipe with a cross rolling mill, and which reduces the friction coefficient between the working tools and the worked material, thereby extending the lives of the working tools.

We have attempted to overcome, by the use of various types of solid lubricants, the problems of heavy wear of plugs and the score of guide shoes which can be encountered in the production of seamless steel pipes by the Mannesmann method, particularly when a stainless steel or an alloy steel is used as the billet material. The friction between the rolled material and the tools, such as the plug and the guide shoes, takes place under extreme temperature conditions: namely, at a high temperature of about 1000° C. or even higher, unlike other ordinary frictions. We have discovered that such a severe friction condition can be withstood in the presence of a fine and strong film of oxides (FeO, $Fe_3O_4$) formed on the plug surface. We then made a study on the melting point and the film strength of such an iron oxide film, with a view to obtain a heat-resistant protective film, thus accomplishing the present invention.

According to one preferred aspect of the present invention, there is provided a lubricant for hot working, comprising, in the form of a mixture:

(A) from about 10 to about 60 wt % of alkali silicate;

(B) from about 1 to about 20 wt % of silane coupling agent;

(C) from about 0.1 to about 5.0 wt % of at least one kind of alkali compound selected from a group consisting of an alkali hydroxide, an alkali carbonate, an alkali borate and an alkali salt of mineral acid; and (D) from about 30 to about 70 wt % of water.

The above-mentioned object of the present invention can be achieved by applying this lubricant to the surface of a plug, or by supplying this lubricant to the surfaces of guide shoes and into the nips between the guide shoe surfaces and the surface of the rolled material.

According to a second preferred aspect of the present invention, there is provided a lubricant for hot working, comprising, in the form of a mixture:

(A) from about 10 to about 60 wt % of alkali silicate;

(B) from about 1 to about 20 wt % of silane coupling agent;

(C) from about 0.1 to about 5.0 wt % of at least one kind of alkali compound selected from a group consisting of an alkali hydroxide, an alkali carbonate, an alkali borate and an alkali salt of mineral acid;

(D) from about 5 to about 50 wt % of water;

(E) from about 10 to about 60 wt % of iron oxide; and (F) from about 0.1 to about 5.0 wt % of at least one additive selected from a group consisting of a dispersant and a thickening agent.

The above-mentioned object of the present invention can be achieved by applying this lubricant to the surface of a plug, or by supplying this lubricant to the surfaces of guide shoes and into the nips between the guide shoe surfaces and the surface of the rolled material. The lubricating effect of this lubricant is remarkable, particularly when the lubricant is supplied into the nips between the guide shoe surfaces and the rolled material.

The present invention in still another preferred aspect provides a composition adapted for use a lubricant, above-mentioned compositions (A), (B), (C), and (D) or (A), (B), (C), (D), (E) and (F) being formed by mixing.

The present invention in still another preferred aspect provides a process for producing a seamless steel pipe in accordance with the Mannesmann method by using a plug, comprising performing rolling on a hollow after applying one of the lubricant set forth above, while maintaining the temperature of the plug surface between about 100° and about 300° C.

The above and other objects, features and advantages of the present invention will become clear from the following description when the same is read in conjunction with the accompanying drawings, as well as from the description of the invention in the appended claims.

DESCRIPTION OF THE PREFERRED EMBODIMENTS

Although this invention is described with reference to particular embodiments of a lubricant and with reference to particular manufacturing processes, it will be appreciated that the invention is not limited to such embodiments or processes. It will also be appreciated that lubricant can vary within the spirit and scope of this invention and that such lubricant can be used in a wide variety of forming or working processes.

(First Embodiment)

Figure 1:
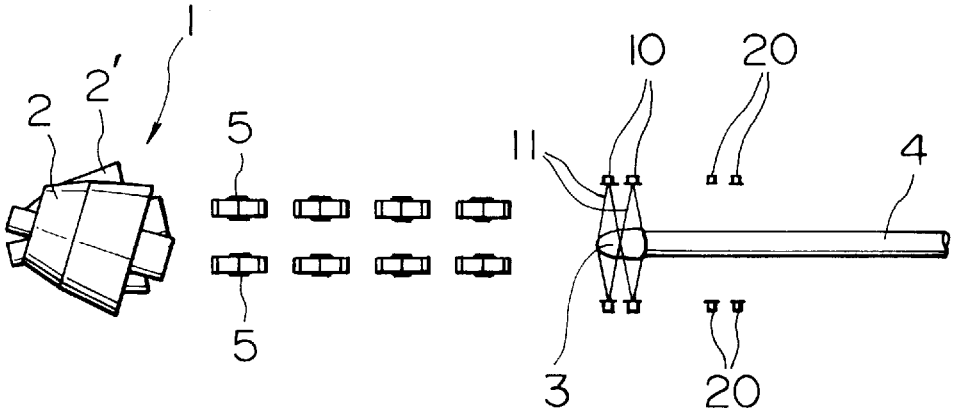
FIG. 1 is a schematic illustration of a cross rolling mill having a plug to which a lubricant in accordance with the present invention is applied.

Referring to FIG. 1 which schematically illustrates a cross rolling mill having a plug to which a lubricant in accordance with the present invention is applied, the cross rolling mill 1 has upper and lower rolling rolls 2, 2' which are skewed with respect to the pass line so as to cross each other. A plug 3 is arranged on the pass line, whereby a billet is pierced and rolled or a hollow bloom is elongated and rolled. Numeral 4 denotes a plug bar, while numeral 5 designates a bar steadier roll.

The plug 3 is repeatedly used in the cross rolling mill 1. Namely, the plug 3 which has worked on a billet or worked hollow is elongated together with the plug bar 4 from the pierced or rolled hollow bloom and is passed through a water shower header 20 so as to be cooled by the water to a temperature of from about 100° to about 300° C. Then, a lubricant applicator head 10, which is disposed in the vicinity of the water shower header 20, applies the lubricant to the surface of the plug 3.

The plug 3 with the lubricant applied thereto is brought again into the cross rolling mill 1 so as to be used in the rolling of the next billet or bloom to be rolled, with the plug bar held by the bar steadier rolls 5.

The hot work lubricant applied to the surface of the plug has a composition which contains:

(A) from about 10 to about 60 wt % of alkali silicate;

(B) from about 1 to about 20 wt % of silane coupling agent (C) from about 0.1 to about 5.0 wt % of at least one kind of alkali compound selected from a group consisting of alkali hydroxides, alkali carbonates, alkali borates and an alkali salt of mineral acid; and (D) from about 30 to about 70 wt % of water.

In order that the lubricant produces an appreciable effect when used on the plug surface during a pipe making process, the lubricant preferably has a softening point (the temperature at which the lubricant is vitrified to exhibit a glassy state) ranging from about 500° C. to about 700° C., more preferably from about 550° C. to about 650° C.

(Second Embodiment)

Figure 2:
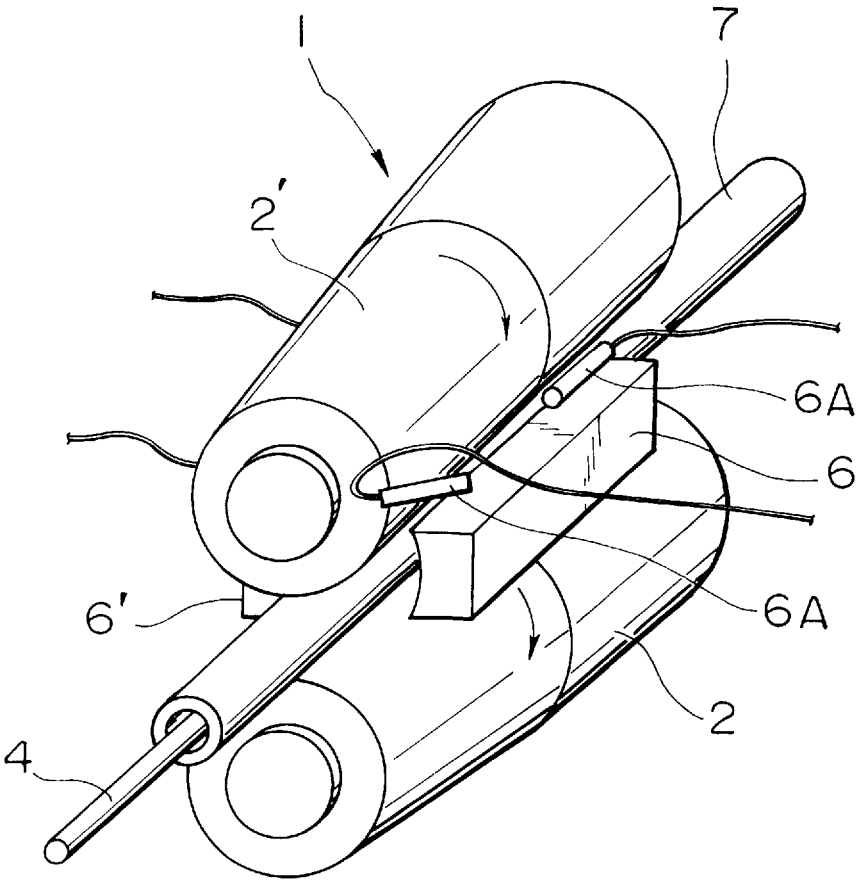
FIG. 2 is a schematic illustration of a cross rolling mill having stationary guide shoes to which a lubricant according to the present invention is applied.

Referring to FIG. 2, which schematically illustrates a cross rolling mill having stationary guide shoes to which a lubricant in accordance with the present invention is applied, the cross rolling mill 1 has upper and lower rolling rolls 2, 2' which are skewed with respect to the pass line so as to cross each other, and a plug 3 (not shown) which is arranged on the pass line, so as to pierce a billet 7 or to elongate a hollow bloom 7. Stationary guide shoes 6, 6' which have rolled a billet or bloom are subjected to rolling the next billet or bloom, after being cooled by the roll cooling water or by water separately supplied exclusively for cooling the guide shoes. Then, a lubricant is supplied to the surfaces of the guide shoes and to the nip between the guide shoes and the rolled material, during the rolling work, by means of a lubricant applying spray header 6A.

The hot work lubricant applied to the surfaces of the guide shoes 6, 6' has a composition which contains:

(A) from about 10 to about 60 wt % of alkali silicate;

(B) from about 1 to about 20 wt % of silane coupling agent;

(C) from about 0.1 to about 5.0 wt % of at least one kind of alkali compound selected from a group consisting of alkali hydroxides, alkali carbonates, alkali borates and an alkali salt of mineral acid;

(D) from about 5 to about 50 wt % of water;

(E) from about 10 to about 60 wt % of iron oxide; and (F) from about 0.1 to about 5.0 wt % of at least one additive selected from a group consisting of a dispersant and a thickening agent.

In order that the lubricant produces an appreciable effect when used on the plug surface during a pipe making process, the lubricant preferably has a softening point (the temperature at which the lubricant is vitrified to exhibit a glassy state) ranging from about 700° C. to about 900° C., more preferably from about 750° C. to about 850° C. Such a high softening point is preferred so that the lubricant of the present invention performs a fluid lubrication at high temperatures. Despite such a high temperature, the strength of the fluid lubricant is maintained by virtue of the addition of iron oxide.

A description will now be given of the reasons for selecting the contents of the elements of the preferred composition of lubricant in accordance with the present invention.

Alkali Silicate: from about 10 to about 60 wt %

Alkali silicate is a primary element which provides lubricating effect, and is contained by an amount ranging from about 10 to about 60 wt % on an anhydride basis. This element has an affect on the lubricating film depending on the ratio in which it is mixed with other components. An alkali silicate content below 10 wt % tends to lower the softening point of the lubricant, thereby decreasing the lubricating effect, whereas a content exceeding 60 wt % tends to increase the softening point, with the result that the expected lubricating effect may not be easily obtained. The alkali metal which forms a salt may be any one of lithium, sodium, potassium, rubidium, cesium and francium. Either one of these alkali metals may be used alone or a plurality of these alkali metals may be used in combination, except that the total content of the alkali silicate should fall within the preferred range specified above. Combinations of alkali metals are often used suitably, in order to adjust the softening point of the lubricant. Among these alkali silicates, sodium and potassium are preferably used, from the view point of economy and availability.

A detailed description will be given of the case where sodium silicate or potassium silicate is used as the alkali silicate. Sodium silicate, which is commonly available, has a mol ratio between $Na_2O$ and $SiO_2$, which generally ranges from about 1:1 to about 1:4. Similarly, potassium silicate, which is commonly available, has a mol ratio between $K_2O$ and $SiO_2$, which generally ranges from about 1:1 to about 1:5. The mol ratio is a factor which affects the nature of the lubricant film formed between the plug and the rolled material or between the guide shoes and the rolled material. Sodium silicate and potassium silicate, which have the ordinary mol ratios as mentioned above, can be used without any problem.

Silane Coupling Agent: from about 1 to about 20 wt %

Silane coupling agent is an element which is used in relation to the alkali silicate, so as to provide adhesion, stiffness and high-temperature durability of the lubricant film formed by the lubricant that is applied to the plug surface, or the lubricant that is supplied to the surfaces of the guide shoes or to the nip between the guide shoe surfaces and the rolled material. The content of this component generally ranges from about 1 to about 20 wt %. A content of the silane coupling agent below 1 wt % may not always provide sufficient adhesion and stiffness of the lubricant film, while a content exceeding 20 wt % could tend to impair the durability of the lubricant film at high temperatures due to an increase in the content of organic matter in the lubricant film.

Each molecule of the silane coupling agent has different types of reaction groups capable of bonding with organic and inorganic matters. Silane coupling agents which are commonly used for fiber-reinforced resins can suitably be used as the silane coupling agent in the lubricant of the present invention, for example. Examples of such silane coupling agents are coupling agents of the vinylsilane type, aminosilane type, methacrylsilane type, chlorosilane type, mercaptosilane type and alkylsilane type. Either one of these types of silane coupling agents may be used alone, or two or more of these silane coupling agents may be used in combination.

According to the present invention, the silane coupling agent is mixed with water. The silane-coupling agent, therefore, is preferably water soluble, although this may not be necessary depending on the amount of the silane coupling agent to be used. It is considered that, in the lubricant of the present invention, part of a molecule of the silane coupling agent may be changed into a silanol group as a result of hydrolysis.

A description will now be given of a preferred form of the silane coupling agent suitable for use in the present invention. The preferred from of an alkyl silane coupling agent is expressed by a general formula of $R_{4-n}SiX_n$, where n is preferably an integer of from about 1 to about 3, while R represents an alkyl group preferably having a carbon number of from about 1 to about 9. At the same time, X represents a group which is to be subjected to the hydrolysis, e.g., alkoxy group or halogen atom. From a view point of ease of handling, X is preferably an alkoxy group. In such a case, the carbon number of the alkoxy group preferably ranges from about 1 to about 7 and, for attaining a hydrophilic nature, the carbon number preferably ranges from about 1 to about 3.

It is contemplated that, from a view point of ease of interface control, a titanate-type or an aluminate-type coupling agent can be used in place of the silane coupling agent used in the present invention.

At least one kind of alkali compound selected from a group consisting of an alkali hydroxide, an alkali carbonate, an alkali borate and an alkali salt of mineral acid: from about 0.1 to about 5.0 wt %

The alkali compound of the type specified above plays, in cooperation with other components such as alkali silicate, silane coupling agent, iron oxide and so forth, a role of controlling the softening point of the lubricant film which is formed by the lubricant that is applied to the surface of the plug or the lubricant which is supplied to the surfaces of the guide shoes or into the nip between the guide shoes and the rolled material. The alkali metal which forms the alkali compound used in the present invention may be of any one of lithium, sodium, potassium, rubidium, cesium and francium. Either one of the alkali compounds formed from these metals may be used alone, or a plurality of such alkali compounds may be used in combination.

The content of the alkali compound ranges from about 0.1 to about 5.0 wt %. Formation of the lubricant tends to become somewhat difficult and, hence, the stability of the lubricant can be partially impaired, when the content of this alkali compound exceeds 5.0 wt %. In order that the softening point is most easily controlled, it is preferred that lithium is used as the alkali metal. The use of lithium compound as the alkali compound is preferred particularly when inexpensive sodium silicate or potassium silicate is used as the alkali silicate.

The lubricant of the present invention preferably has the form of an alkaline aqueous solution. Solubility in alkaline water, therefore, is one preferred criteria for selecting the alkali compound. From this point of view, the alkali compound preferably has the form of a hydroxide. Thus, lithium hydroxide is used more preferably as the alkali compound. The present invention, however, does not exclude the use of other types of salt. For instance, borax can suitably be used as the alkali compound in the lubricant of the present invention.

A lubricant coat film formed of this lubricant has a softening point which preferably ranges from about 700° to about 900° C., more preferably from about 750° to about 850° C.

Water: from about 30 to about 70 wt % or from about 5 to about 50 wt %

The lubricant of the present invention is formed as a result of hydrolysis of the silane coupling agent in the presence of water. The preferred content of water depends on the amount of other components. In general, however, a water content that is too small tends to render the lubricant too sticky or too viscous, thereby making it somewhat difficult to apply the lubricant to the plug or to supply the same to the guide shoes. On the other hand, a water content that is too large can hamper adhesion of the lubricant to the surfaces of the plug and the guide shoes, as well as introduction of the lubricant into the nip between the guide shoe surfaces and the rolled material. For these reasons, the content of water in the lubricant of the present invention is preferably determined as follows, in relation to the contents of other components.

Namely, when the lubricant is of the first aspect of the present invention which contains (A) from about 10 to about 60 wt % of alkali silicate, (B) from about 1 to about 20 wt % of silane coupling agent, and (C) from about 0.1 to about 5.0 wt % of at least one kind of alkali compound selected from a group consisting of an alkali hydroxide, an alkali carbonate, an alkali borate and an alkali salt of mineral acid, the water content preferably ranges from about 30 to about 70 wt %. Presence of water in excess of 70 wt % can cause the lubricant liquid to be too thin, making it somewhat difficult to apply the lubricant to the plug and guide shoes. Conversely, water content below 30 wt % can excessively thicken the lubricant liquid, thereby somewhat hampering the adhesion of the lubricant to the surfaces of the plug and the guide shoes, as well as introduction into the nip between the guide shoes and the rolled material.

The water content, however, preferably ranges from about 5 to about 50 wt %, when the lubricant is of the second aspect of the present invention which contains (A) from about 10 to about 60 wt % of alkali silicate, (B) from about 1 to about 20 wt % of silane coupling agent, (C) from about 0.1 to about 5.0 wt % of at least one kind of alkali compound selected from a group consisting of an alkali hydroxide, an alkali carbonate, an alkali borate and an alkali salt of mineral acid, (E) from about 10 to about 60 wt % of iron oxide, and (F) from about 0.1 to about 5.0 wt % of at least one additive selected from a group consisting of a dispersant and a thickening agent.

In the lubricant of the second aspect, the water content is preferably reduced as compared with that of the second aspect by an amount corresponding to the contents of iron oxide and the additive. The presence of water in excess of 50 wt % can make the liquid too thin, with the result that application of the lubricant to the plug or supply of the same to the guide shoes becomes difficult. Conversely, a water content below 5 wt % can excessively thicken the lubricant liquid, so as to somewhat impair adhesion of the lubricant to the surfaces of the plug and the guide shoes, and possibly making it difficult to introduce the lubricant into the nip between the guide shoe surfaces and the rolled material.

Iron Oxide: from about 10 to about 60 wt %

We have discovered that friction under extreme conditions, such as those encountered in the hot rolling employed in the Mannesmann process for producing seamless steel pipe, can be satisfactorily reduced by the film of iron oxides (FeO, $Fe_3O_4$) having a fine and strong structure formed on the surface of the plug. We also discovered that the presence of an iron oxide component in the lubricant is preferred from the view point of the lubrication effect at high temperature. Preferably, the content of the iron oxide ranges from about 10 to about 60 wt %. When the lubricant of the present invention is intended to be applied to the plug surface, the iron oxide content may be comparatively small, because a plug can have an iron oxide film inherently formed on the plug surface. However, when the lubricant is intended specifically to be supplied into the nip between the guide shoes and the rolled material, a comparatively large iron oxide content may be employed. Presence of iron oxide in excess of 60 wt %, however, can tend to cause defects such as flaws on the rolled material. Conversely, a small iron oxide content below 10 wt % can lead to wear of the plug and the guide shoes, resulting in somewhat shorter lives of these tools.

The iron oxide may be any of a ferrous oxide (FeO), ferric oxide ($Fe_2O_3$) and tri-iron tetroxide ($Fe_3O_4$), for example. In order that the iron oxide is more uniformly dispersed, however, it is preferred that the average grain size of the iron oxide ranges from about 0.1 $\mu$m to about 500 $\mu$m. When the average grain size exceeds 500 $\mu$m, iron oxide tends to precipitate in the composition of the invention so as to make it difficult to uniformly disperse the iron oxide. Conversely, when the average grain size is smaller than 0.1 $\mu$m, the strength of the lubricant fluid can be somewhat reduced, thereby reducing the expected lubrication effect.

At least one type of additive selected from the group consisting of dispersant and thickening agent: from about 0.1 to about 5.0 wt %.

Preferably, a thickening agent and/or a dispersant are/is used in order to achieve a more uniform dispersion of the iron oxide. To this end, the content of the dispersant and/or the thickening agent ranges from about 0.1 to about 5.0 wt %. Inclusion of the dispersant and/or the thickening agent in excess of 5.0 wt %, however, could impair adhesion of the lubricant to the surfaces of the plug and the guide shoes and, hence, is not preferred, although it improves dispersion of the iron oxide in the lubricant of the present invention. Conversely, a small content of the dispersant and/or the thickening agent can tend to impair dispersion of the iron oxide. Preferably, therefore, the content of the dispersant and/or thickening agent ranges between about 0.1 and about 5.0 wt %.

The additives usable as the thickening agent or dispersant in the lubricant of the present invention are cellulose, natural rubber polysaccharides or surfactants. For example those are sodium alginate, propylene glycol ester alginate, casein soda, sodium carboxymethylcellulose, ammonium carboxymethylcellulose, sodium starchglycolate, sodium starch acid, sodium polyacrylate, methylcellulose, hydroxymethylcellulose, hydroxyethylcellulose, carboxypropylenecellulose, gum arabic, alginic acid, casein, guar gum, gluten, starch, lowcust bean gum, and xanthene gum, alkylamine, metal salt of an aliphatic acid and alkyl sulfate, mono- and tri-aliphatic acid ester of sorbitan, lanolin derivative, lecithin, metallic soap, polyoxyethylalkylether, polyoxyethyleneglycol aliphatic acid ester, and dialkylsulfosuccinate. According to the present invention, it is also possible to use a surfactant so as to enhance the hydrophilic nature of the surfaces of the iron oxide grains, thus promoting more uniform dispersion of the iron oxide throughout the lubricant of the present invention.

In accordance with the present invention, a seamless steel pipe is produced by means of a cross rolling mill of the type shown in FIGS. 1 or 2, with the described lubricant applied to the plug surface or supplied to the guide shoes. It is preferred that, when the lubricant is applied to the plug surface, the plug is cooled so that the temperature of its surface is maintained within a range of from about 100° C. to about 300° C. Adhesion of the lubricant to the plug surface can be impaired in some cases when the plug temperature does not fall within this range. The supply of the lubricant to the guide shoes is preferably performed by spraying.

It will be needless to say that the hot work lubricant of the present invention can effectively be used not only in a Mannesmann process for producing seamless steel pipes but also to various other processes which require lubrication under extreme conditions.

The following Examples illustrate preferred aspects of the lubricant according to this invention. The Examples are not intended to define or limit the scope of this invention, which is defined separately in the appended claims.

EXAMPLES

Example 1

The present invention was carried out by using a cross rolling mill of the type shown in FIG. 1. Each of the plugs 3 which were used in one cycle of pipe-producing process was cooled by means of water shower and, while its surface was maintained within the temperature range of from 170° C. to 250° C., a lubricant was applied to the plug surface. More specifically, thirteen types of lubricant in accordance with the present invention, shown in Tables 1—1 to 2—2, were used. Test rolling operations also were performed without lubrication (comparative example 1) and using a lubricant which was a 40 wt % aqueous solution of sodium silicate #1 ($Na_2O:SiO_2$=1:2)(comparative example 2), for the purpose of comparison.

The amount of lubricant applied to each plug was 150 cc. The atomization pressure (air atomization) was 3 kgf/cm$^2$ for the lubricant and 2 kgf/cm$^2$ for the air.

A plug 3 of 0.3% C–0.5% Cr–1.5% Ni-type material, having an oxide scale of about 400 $\mu$m thick formed thereon, was used for piercing performed in the piercer, as well as for elongating in the elongator. Each lubricant was tested in piercing and elongating of 200 billets, each being 210 mm in diameter and 2 m in length, of high-alloy steel having Cr content of 13% or higher. The state of wear of the plug surface was examined each time of use after water cooling. The plug was renewed when the examination indicated that the plug life had expired due to melting, wear or breakage.

Tables 1—1 to 2—2 also show the lives of the plugs in terms of the number of the billets of the high-alloy steels of 13% Cr or higher class which could be successfully pierced and elongated, among the 200 billets. It will be seen that the plug lubricated with the lubricant of the invention generally exhibits a life which is about 2 or more times as long as that exhibited when no lubrication was used, both in piercing and elongating. It will be also seen that the lubrication with the 40 wt % aqueous solution of sodium silicate #1 alone could not provide any significant effect of extending the plug life over the case where no lubrication was used.

Example 2

The present invention was carried out by using a cross rolling mill of the type shown in FIG. 2. Lubricant was supplied to the entire area of contact between the guide shoe surface and the rolled material, from spray heads 6A which were provided at the upstream or inlet side of each guide shoe 6 as viewed in the direction of rotation of the rolled material. Sixteen types of lubricants of the invention as shown in Tables 3-1 to 5-2 were used.

Test rolling operations also were performed without lubrication (comparative example 1) and using a lubricant which was a 40 wt % aqueous solution of sodium silicate #1 ($Na_2O:SiO_2$=1:2)(comparative example 2), for the purpose of comparison.

The supply of the lubricant was conducted at a rate of 20 cc/cm for each of the pair of guide shoes 6. The atomization pressure (air atomization) was 3 kgf/cm$^2$ for the lubricant and 2.5 kgf/cm$^2$ for the air.

The guide shoes employed in the piercing performed by the piercer and elongating performed by the elongator were made of a 1.3% C–30% Cr–30% Ni type material. Each lubricant was tested in piercing and elongating of 250 billets, each being 210 mm in diameter and 2 m in length, of high-alloy steel having Cr content of 13% or higher. The surfaces of the guide shoes were examined after each rolling. The guide shoes were renewed when the examination indicated that the shoe life had expired due to score, wear or heat cracking.

Tables 3-1 to 5-2 also show the lives of the guide shoes in terms of the number of the billets of the high-alloy steels of 13% Cr or higher class which could be successfully pierced and elongated, among the 250 billets. It will be seen that the guide shoes lubricated with the lubricant of the invention generally exhibit a life which is about 3 or more times as long as that exhibited when no lubrication was used, both in piercing and elongating. It will be also seen that the lubrication with the 40 wt % aqueous solution of sodium silicate #1 alone could not provide any significant effect of extending the guide shoe life over the case where no lubrication was used.

As will be understood from the foregoing description, according to the invention, it is possible to easily extend the lives of hot work tools such as plugs or other tools such as those used in the rolling of seamless steel pipes and which have to sustain severe working conditions such as those in piercing and elongating of high-alloy steels.

TABLE 1-1

(Unit: wt %)

| Composition | Ex. 1 | Ex. 2 | Ex. 3 | Ex. 4 | Ex. 5 | Ex. 6 | Ex. 7 |
|---|---|---|---|---|---|---|---|
| Sodium silicate | | | | | | | |
| (1) $Na_2O:SiO_2$ = 1:1 | 10.0 | — | 20.0 | — | 10.0 | — | — |
| (2) $Na_2O:SiO_2$ = 1:2 | — | 20.0 | — | 10.0 | — | 30.0 | 10.0 |
| (3) $Na_2O:SiO_2$ = 1:3 | 20.0 | — | 40.0 | — | 20.0 | — | — |
| (4) $Na_2O:SiO_2$ = 1:4 | — | — | — | 20.0 | — | — | 20.0 |
| Potassium silicate | | | | | | | |
| (1) $K_2O:SiO_2$ = 1:1 | — | — | — | — | — | — | — |
| (2) $K_2O:SiO_2$ = 1:2 | — | — | — | — | — | — | — |
| (3) $K_2O:SiO_2$ = 1:3 | — | — | — | — | — | — | — |
| (4) $K_2O:SiO_2$ = 1:4 | — | — | — | — | — | — | — |
| (5) $K_2O:SiO_2$ = 1:5 | — | — | — | — | — | — | — |
| Silane coupling agent | | | | | | | |
| (1) Methyltriethoxy-silane | — | — | — | — | — | 10.0 | — |
| (2) Methyltrimethoxy-silane | 10.0 | — | 5.0 | — | — | — | — |
| *(3) Vinyl silane | — | — | — | 10.0 | — | — | — |
| *(4) Amino silane | — | 10.0 | — | — | — | — | — |
| *(5) Methacryll silane | — | — | — | — | 1.0 | — | — |
| *(6) Mercapto silane | — | — | — | — | — | — | 20.0 |
| *(7) Chloro silane | — | — | — | — | — | — | — |

*(3) Vinylethoxysilane
*(4) γ-Aminopropylmethoxysilane
*(5) γ-Methacriloxypropyl trimethoxysilane
*(6) γ-Mercaptopropyl trimethoxysilane
*(7) γ-Chloropropyl trimethoxysilane

TABLE 1-2

(Unit: wt %)

| Composition | Ex. 1 | Ex. 2 | Ex. 3 | Ex. 4 | Ex. 5 | Ex. 6 | Ex. 7 |
|---|---|---|---|---|---|---|---|
| Lithium hydroxide | 2.0 | — | — | — | 5.0 | 2.0 | — |
| Lithium borate | — | — | — | — | — | — | 5.0 |
| Sodium hydroxide | — | 2.0 | — | — | — | — | — |
| Sodium borate | — | — | — | — | — | — | — |
| Sodium carbonate | — | — | — | 0.1 | — | — | — |
| Potassium hydroxide | — | — | 2.0 | — | — | — | — |
| Potassium carbonate | — | — | — | — | — | — | — |
| Iron oxide | | | | | | | |
| (1) FeO | — | — | — | — | — | — | — |
| (2) $Fe_2O_2$ | — | — | — | — | — | — | — |
| (3) $Fe_3O_4$ | — | — | — | — | — | — | — |
| Dispersant | | | | | | | |
| (1) Sodium alginate | — | — | — | — | — | — | — |
| (2) Xanthene | — | — | — | — | — | — | — |

TABLE 1-2-continued (Unit: wt %)

| Composition | Ex. 1 | Ex. 2 | Ex. 3 | Ex. 4 | Ex. 5 | Ex. 6 | Ex. 7 |
|---|---|---|---|---|---|---|---|
| gum | | | | | | | |
| Water | 58.0 | 68.0 | 33.0 | 59.5 | 64.0 | 58.0 | 45.0 |
| Plug life (piercing) | 17–20 | 7–10 | 9–14 | 16–18 | 16–19 | 18–20 | 17–20 |
| Plug life (elongating) | 26–31 | 17–19 | 17–22 | 23–28 | 24–28 | 25–30 | 25–32 |

TABLE 2-1

(Unit: wt %)

| Composition | Ex. 8 | Ex. 9 | Ex. 10 | Ex. 11 | Ex. 12 | Ex. 13 | Com. Ex. 1 | Com. Ex. 2 |
|---|---|---|---|---|---|---|---|---|
| Sodium silicate | | | | | | | | |
| (1) $Na_2O$: $SiO_2$ = 1:1 | 20.0 | — | — | 10.0 | — | — | — | 40.0 |
| (2) $Na_2O$: $SiO_2$ = 1:2 | — | 10.0 | 10.0 | — | 20.0 | 50.0 | — | — |
| (3) $Na_2O$: $SiO_2$ = 1:3 | 40.0 | — | 20.0 | 20.0 | — | — | — | — |
| (4) $Na_2O$: $SiO_2$ = 1:4 | — | 20.0 | — | — | 20.0 | — | — | — |
| Potassium silicate | | | | | | | | |
| (1) $K_2O$:$SiO_2$ = 1:1 | — | — | — | — | — | — | — | — |
| (2) $K_2O$:$SiO_2$ = 1:2 | — | — | — | — | — | — | — | — |
| (3) $K_2O$:$SiO_2$ = 1:3 | — | — | — | — | — | — | — | — |
| (4) $K_2O$:$SiO_2$ = 1:4 | — | — | — | — | — | — | — | — |
| (5) $K_2O$:$SiO_2$ = 1:5 | — | — | — | — | — | — | — | — |
| Silane coupling | | | | | | | | |

TABLE 2-1-continued (Unit: wt %)

| Composition | Ex. 8 | Ex. 9 | Ex. 10 | Ex. 11 | Ex. 12 | Ex. 13 | Com. Ex. 1 | Com. Ex. 2 |
|---|---|---|---|---|---|---|---|---|
| agent | | | | | | | | |
| (1) Methyltri-ethoxysilane | — | — | — | 10.0 | — | — | — | — |
| (2) Methyltri-methoxysilane | — | — | — | — | — | — | — | — |
| *(3) Vinyl silane | — | — | — | — | 10.0 | — | — | — |
| *(4) Amino silane | 2.0 | — | — | — | — | — | — | — |
| *(5) Methacryll silane | — | — | — | — | — | 5.0 | — | — |
| *(6) Mercapto silane | — | 15.0 | — | — | — | — | — | — |
| *(7) Chloro silane | — | — | 2.0 | — | — | — | — | — |

*(3) Vinylethoxysilane
*(4) γ-Aminopropylmethoxysilane
*(5) γ-Methacriloxypropyl trimethoxysilane
*(6) γ-Mercaptopropyl trimethoxysilane
*(7) γ-Chloropropyl trimethoxysilane

TABLE 2-2

(Unit: wt %)

| Composition | Ex. 8 | Ex. 9 | Ex. 10 | Ex. 11 | Ex. 12 | Ex. 13 | Com. Ex. 1 | Com. Ex. 2 |
|---|---|---|---|---|---|---|---|---|
| Lithium hydroxide | — | — | — | — | — | 1.5 | — | — |
| Lithium borate | — | — | — | — | 3.0 | — | — | — |
| Sodium hydroxide | — | — | — | — | — | — | — | — |
| Sodium borate | — | — | 2.0 | — | — | — | — | — |
| Sodium carbonate | — | — | — | 0.5 | — | — | — | — |
| Potassium hydroxide | 2.0 | — | — | — | — | — | — | — |
| Potassium carbonate | — | 1.0 | — | — | — | — | — | — |
| Iron oxide | | | | | | | | |
| (1) FeO | — | — | — | — | — | — | — | — |
| (2) $Fe_2O_2$ | — | — | — | — | — | — | — | — |
| (3) $Fe_3O_4$ | — | — | — | — | — | — | — | — |
| Dispersant | | | | | | | | |
| (1) Sodium alginate | — | — | — | — | — | — | — | — |
| (2) Xanthene gum | — | — | — | — | — | — | — | — |

TABLE 2-2-continued (Unit: wt %)

| Composition | Ex. 8 | Ex. 9 | Ex. 10 | Ex. 11 | Ex. 12 | Ex. 13 | Com. Ex. 1 | Com. Ex. 2 |
|---|---|---|---|---|---|---|---|---|
| Water | 36.0 | 54.0 | 66.0 | 59.5 | 47.0 | 43.5 | — | 60.0 |
| Plug life (piercing) | 10–15 | 14–17 | 15–18 | 15–18 | 18–20 | 22–24 | 3–5 | 3–5 |
| Plug life (elongating) | 17–21 | 22–27 | 23–28 | 25–29 | 26–31 | 28–33 | 7–8 | 7–10 |

TABLE 3-1

(Unit: wt %)

| Composition | Ex. 1 | Ex. 2 | Ex. 3 | Ex. 4 | Ex. 5 | Ex. 6 |
|---|---|---|---|---|---|---|
| Sodium silicate | | | | | | |
| (1) $Na_2O:SiO_2$ = 1:1 | 22.5 | — | — | — | 5.0 | — |
| (2) $Na_2O:SiO_2$ = 1:2 | — | — | 30.0 | — | — | 15.0 |
| (3) $Na_2O:SiO_2$ = 1:3 | — | — | — | 30.0 | 20.0 | — |
| (4) $Na_2O:SiO_2$ = 1:4 | — | 20.0 | — | — | — | — |
| Potassium silicate | | | | | | |
| (1) $K_2O:SiO_2$ = 1:1 | 22.5 | 10.0 | — | — | — | — |
| (2) $K_2O:SiO_2$ = 1:2 | — | — | 20.0 | — | — | — |
| (3) $K_2O:SiO_2$ = 1:3 | — | — | — | 20.0 | — | — |
| (4) $K_2O:SiO_2$ = 1:4 | — | — | — | — | — | 10.0 |
| (5) $K_2O:SiO_2$ = 1:5 | — | — | — | — | 25.0 | 5.0 |
| Silane coupling agent | | | | | | |
| (1) Methyltriethoxysilane | 3.0 | — | — | — | — | — |
| (2) Methyltrimethoxysilane | — | 10.0 | — | — | 5.0 | — |
| *(3) Vinyl silane | — | — | 5.0 | — | — | — |
| *(4) Amino silane | — | — | — | — | — | — |
| *(5) Methacryll silane | — | — | — | 3.0 | — | — |
| *(6) Mercapto silane | — | — | — | — | — | 3.0 |
| *(7) Chloro silane | — | — | — | — | — | — |

*(3) Vinylethoxysilane
*(4) γ-Aminopropylmethoxysilane
*(5) γ-Methacriloxypropyl trimethoxysilane
*(6) γ-Mercaptopropyl trimethoxysilane
*(7) γ-Chloropropyl trimethoxysilane

TABLE 3-2

(Unit: wt %)

| Composition | Ex. 1 | Ex. 2 | Ex. 3 | Ex. 4 | Ex. 5 | Ex. 6 |
|---|---|---|---|---|---|---|
| Lithium hydroxide | 2.0 | — | — | — | — | 1.0 |
| Lithium borate | — | — | — | — | — | — |
| Sodium hydroxide | — | 1.5 | — | — | — | — |
| Sodium borate | — | — | — | — | 1.0 | — |
| Sodium carbonate | — | — | — | 0.5 | — | — |
| Potassium hydroxide | — | — | 0.1 | — | — | — |
| Potassium carbonate | — | — | — | — | — | — |
| Iron oxide | | | | | | |
| (1) FeO | — | 20.0 | — | — | — | — |
| (2) $Fe_2O_2$ | — | — | 25.0 | — | 25.0 | — |
| (3) $Fe_3O_4$ | 10.0 | — | — | 10.0 | — | 50.0 |
| Dispersant | | | | | | |
| (1) Sodium alginate | 0.1 | 5.0 | — | 0.5 | — | 0.1 |
| (2) Xanthene gum | — | — | 1.0 | — | 0.5 | — |
| Water | 39.9 | 33.5 | 18.9 | 36.0 | 18.5 | 15.9 |

TABLE 3-2-continued (Unit: wt %)

| Composition | Ex. 1 | Ex. 2 | Ex. 3 | Ex. 4 | Ex. 5 | Ex. 6 |
|---|---|---|---|---|---|---|
| Guide shoe life (piercing) | 16–19 | 18–21 | 17–19 | 18–22 | 20–22 | 21–24 |
| Guide shoe life (elongating) | 59–62 | 63–68 | 60–65 | 66–72 | 65–69 | 70–76 |

TABLE 4-1

(Unit: wt %)

| Composition | Ex. 7 | Ex. 8 | Ex. 9 | Ex. 10 | Ex. 11 | Ex. 12 |
|---|---|---|---|---|---|---|
| Sodium silicate | | | | | | |
| (1) $Na_2O:SiO_2$ = 1:1 | 35.0 | 10.0 | — | — | — | 5.0 |
| (2) $Na_2O:SiO_2$ = 1:2 | — | — | 55.0 | 30.0 | — | — |
| (3) $Na_2O:SiO_2$ = 1:3 | — | 5.0 | — | — | — | 10.0 |
| (4) $Na_2O:SiO_2$ = 1:4 | — | — | — | — | 10.0 | — |
| Potassium silicate | | | | | | |
| (1) $K_2O:SiO_2$ = 1:1 | — | 5.0 | — | — | 25.0 | — |
| (2) $K_2O:SiO_2$ = 1:2 | 25.0 | — | 5.0 | — | 5.0 | — |
| (3) $K_2O:SiO_2$ = 1:3 | — | — | — | — | — | — |
| (4) $K_2O:SiO_2$ = 1:4 | — | — | — | — | — | — |
| (5) $K_2O:SiO_2$ = 1:5 | — | — | — | 5.0 | — | 10.0 |
| Silane coupling agent | | | | | | |
| (1) Methyltriethoxy-silane | 10.0 | — | — | — | — | — |
| (2) Methyltrimethoxy-silane | — | — | 10.0 | — | — | — |
| *(3) Vinyl silane | — | — | — | — | — | — |
| *(4) Amino silane | — | 5.0 | — | 5.0 | — | — |
| *(5) Methacryll silane | — | — | — | — | — | 10.0 |
| *(6) Mercapto silane | — | — | — | — | — | — |
| *(7) Chloro silane | — | — | — | — | 5.0 | — |

*(3) Vinylethoxysilane
*(4) γ-Aminopropylmethoxysilane
*(5) γ-Methacriloxypropyl trimethoxysilane
*(6) γ-Mercaptopropyl trimethoxysilane
*(7) γ-Chloropropyl trimethoxysilane

TABLE 4-2

(Unit: wt %)

| Composition | Ex. 7 | Ex. 8 | Ex. 9 | Ex. 10 | Ex. 11 | Ex. 12 |
|---|---|---|---|---|---|---|
| Lithium hydroxide | — | — | 2.0 | — | — | — |
| Lithium borate | — | 0.2 | — | — | — | — |
| Sodium hydroxide | — | — | — | 2.0 | — | — |
| Sodium borate | — | — | — | — | — | — |
| Sodium carbonate | — | — | — | — | 0.5 | — |
| Potassium hydroxide | — | — | — | — | — | 1.0 |

TABLE 4-2-continued (Unit: wt %)

| Composition | Ex. 7 | Ex. 8 | Ex. 9 | Ex. 10 | Ex. 11 | Ex. 12 |
|---|---|---|---|---|---|---|
| Potassium carbonate | 0.5 | — | — | — | — | — |
| Iron oxide | | | | | | |
| (1) FeO | 22.0 | — | — | — | — | — |
| (2) $Fe_2O_2$ | — | — | — | 25.0 | — | 25.0 |
| (3) $Fe_3O_4$ | — | 30.0 | 15.0 | — | 10.0 | — |
| Dispersant | | | | | | |
| (1) Sodium alginate | — | 0.2 | 0.5 | — | 0.5 | — |
| (2) Xanthene gum | — | — | — | 1.0 | — | 0.5 |
| Water | 7.0 | 44.6 | 12.5 | 32.0 | 44.0 | 38.5 |
| Guide shoe life (piercing) | 18–20 | 17–20 | 19–22 | 17–20 | 18–22 | 20–23 |
| Guide shoe life (elongating) | 60–63 | 60–63 | 67–72 | 61–64 | 66–72 | 65–69 |

TABLE 5-1

(Unit: wt %)

| Composition | Ex. 13 | Ex. 14 | Ex. 15 | Ex. 16 | Comp. Ex. 1 | Comp. Ex. 2 |
|---|---|---|---|---|---|---|
| Sodium silicate | | | | | | |
| (1) $Na_2O$: $SiO_2$ = 1:1 | — | 10.0 | 15.0 | — | — | 40.0 |
| (2) $Na_2O$: $SiO_2$ = 1:2 | 5.0 | — | — | — | — | — |
| (3) $Na_2O$: $SiO_2$ = 1:3 | — | — | — | 5.0 | — | — |
| (4) $Na_2O$: $SiO_2$ = 1:4 | — | — | — | 5.0 | — | — |
| Potassium silicate | | | | | | |
| (1) $K_2O$:$SiO_2$ = 1:1 | — | 25.0 | — | — | — | — |
| (2) $K_2O$:$SiO_2$ = 1:2 | — | — | 30.0 | 15.0 | — | — |
| (3) $K_2O$:$SiO_2$ = 1:3 | 5.0 | — | — | — | — | — |
| (4) $K_2O$:$SiO_2$ = 1:4 | 5.0 | — | — | — | — | — |
| (5) $K_2O$:$SiO_2$ = 1:5 | — | — | — | — | — | — |
| Silane coupling agent | | | | | | |
| (1) Methyltri-ethoxysilane | — | 20.0 | — | 5.0 | — | — |
| (2) Methyltri-methoxysilane | — | — | — | — | — | — |
| *(3) Vinyl silane | — | — | 10.0 | — | — | — |
| *(4) Amino silane | — | — | — | 0.2 | — | — |
| *(5) Methacryll silane | — | — | — | — | — | — |
| *(6) Mercapto silane | 3.0 | — | — | — | — | — |
| *(7) Chloro silane | — | — | — | — | — | — |

*(3) Vinylethoxysilane
*(4) γ-Aminopropylmethoxysilane
*(5) γ-Methacriloxypropyl trimethoxysilane
*(6) γ-Mercaptopropyl trimethoxysilane
*(7) γ-Chloropropyl trimethoxysilane

TABLE 5-2

(Unit: wt %)

| Composition | Ex. 13 | Ex. 14 | Ex. 15 | Ex. 16 | Com. Ex. 1 | Com. Ex. 2 |
|---|---|---|---|---|---|---|
| Lithium hydroxide | 1.0 | — | — | — | — | — |
| Lithium borate | — | 5.0 | — | — | — | — |
| Sodium hydroxide | — | — | — | — | — | — |
| Sodium borate | — | — | — | 2.0 | — | — |
| Sodium carbonate | — | — | — | — | — | — |
| Potassium hydroxide | — | — | — | — | — | — |
| Potassium carbonate | — | — | 1.0 | — | — | — |
| Iron oxide | | | | | | |
| (1) FeO | — | 20.0 | 20.0 | — | — | — |
| (2) $Fe_2O_2$ | — | — | — | — | — | — |
| (3) $Fe_3O_4$ | 50.0 | — | — | 60.0 | — | — |
| Dispersant | | | | | | |
| (1) Sodium alginate | 0.1 | — | 2.0 | 1.5 | — | — |
| (2) Xanthene gum | — | 5.0 | — | — | — | — |
| Water | 30.9 | 15.0 | 22.0 | 6.5 | — | 60.0 |
| Guide shoe life (piercing) | 21–24 | 17–21 | 19–22 | 22–25 | 3–4 | 3–5 |
| Guide shoe life (elongating) | 70–76 | 61–65 | 63–65 | 70–76 | 13–15 | 14–17 |

What is claimed is:

1. A lubricant for hot working, comprising, in the form of a mixture:

(A) from about 10 to about 60 wt % of an alkali silicate;

(B) from about 1 to about 20 wt % of a silane coupling agent;

(C) from about 0.1 to about 5.0 wt % of at least one kind of an alkali compound selected from a group consisting of an alkali hydroxide, an alkali carbonate, an alkali borate and an alkali salt of mineral acid; and (D) from about 30 to about 70 wt % of water, said weight % being based on the weight of the entire mixture.

2. The lubricant composition of claim 1, wherein the alkali silicate of the component (A) comprises sodium silicate, and the alkali compound of the component (C) comprises a sodium compound.

3. The lubricant composition of claim 1, wherein the alkali silicate of the component (A) comprises sodium silicate, and the alkali compound of the component (C) comprises a potassium compound.

4. The lubricant composition of claim 1, wherein the alkali silicate of the component (A) comprises sodium silicate, and the alkali compound of the component (C) comprises a lithium compound.

5. The lubricant composition of claim 4, wherein said lithium compound of the component (C) comprises lithium hydroxide.

6. A lubricant for hot working, comprising, in the form of a mixture:

(A) from about 10 to about 60 wt % of an alkali silicate;

(B) from about 1 to about 20 wt % of a silane coupling agent;

(C) from about 0.1 to about 5.0 wt % of at least one kind of an alkali compound selected from a group consisting of an alkali hydroxide, an alkali carbonate, an alkali borate and an alkali salt of mineral acid;

(D) from about 5 to about 50 wt % of water;

(E) from about 10 to about 60 wt % of an iron oxide; and (F) from about 0.1 to about 5.0 wt % of at least one additive selected from a group consisting of a dispersant and a thickening agent, said weight % being based on the weight of the entire mixture.

7. The lubricant composition of claim 6, wherein the alkali silicate of component (A) comprises at least one alkali silicate selected from the group consisting of a sodium silicate and a potassium silicate.

8. The lubricant composition of claim 6 or 7, wherein the alkali compound of the component (C) comprises a sodium compound.

9. The lubricant composition of claim 6 or 7, wherein the alkali compound of the component (C) comprises a potassium compound.

10. The lubricant composition of claim 6 or 7, wherein the alkali compound of the component (C) comprises a lithium compound.

11. The lubricant composition of claim 10, wherein said lithium compound comprises lithium hydroxide.

12. A composition adapted for use as a lubricant, said composition being formed by mixing:

(A) from about 10 to about 60 wt % of an alkali silicate;

(B) from about 1 to about 20 wt % of a silane coupling agent;

(C) from about 0.1 to about 5.0 wt % of at least one kind of an alkali compound selected from a group consisting of an alkali hydroxide, an alkali carbonate, an alkali borate and an alkali salt of mineral acid; and (D) from about 30 to about 70 wt % of water, said weight % being based on the weight of the entire mixture.

13. A composition adapted for use as a lubricant, said composition being formed by mixing:

(A) from about 10 to about 60 wt % of an alkali silicate;

(B) from about 1 to about 20 wt % of a silane coupling agent;

(C) from about 0.1 to about 5.0 wt % of at least one kind of an alkali compound selected from a group consisting of an alkali hydroxide, an alkali carbonate, an alkali borate and alkali salt of mineral acid;

(D) from about 5 to about 50 wt % of water;

(E) from about 10 to about 60 wt % of an iron oxide; and (F) from about 0.1 to about 5.0 wt % of at least one additive selected from a group consisting of a dispersant and a thickening agent, said weight % being based on the weight of the entire mixture.

* * * * *